US006557990B2

(12) United States Patent
Altendorf

(10) Patent No.: US 6,557,990 B2
(45) Date of Patent: May 6, 2003

(54) EVACUATED STRUCTURES FOR REMOVING ACCUMULATED AIR

(75) Inventor: John M. Altendorf, Corvallis, OR (US)

(73) Assignee: Hewlett-Packard Development Company, Palo Alto, CA (US)

( * ) Notice: Subject to any disclaimer, the term of this patent is extended or adjusted under 35 U.S.C. 154(b) by 0 days.

(21) Appl. No.: 09/843,470

(22) Filed: Apr. 26, 2001

(65) Prior Publication Data

US 2002/0158950 A1 Oct. 31, 2002

(51) Int. Cl.[7] ..... B41J 2/19
(52) U.S. Cl. ..... 347/92
(58) Field of Search ..... 347/85, 86, 87, 347/92

(56) References Cited

U.S. PATENT DOCUMENTS 4,489,334 A * 12/1984 Owatari ..... 347/92
5,440,333 A 8/1995 Sykora et al. ..... 347/87
5,808,643 A * 9/1998 Tracy et al. ..... 347/92
5,936,650 A 8/1999 Ouchida et al. ..... 347/89
6,050,682 A 4/2000 Pawlowski, Jr. et al. ..... 347/92
6,203,146 B1 3/2001 Pawlowski, Jr. et al. ..... 347/85

* cited by examiner

*Primary Examiner*—Anh T. N. Vo
(74) *Attorney, Agent, or Firm*—Timothy F. Myers

(57) ABSTRACT

An evacuated structure removes air accumulated within a container that contains material held at a first pressure. The evacuated structure has a shell that includes a slowly defusing air-permeable material. The air permeable material interfaces to a volume of space evacuated to a second pressure less than the first pressure within the container. Unwanted air that accumulates within the container is drawn into the volume of space of the evacuated structure due to the difference in pressure between the interior of the container and the interior of the shell.

31 Claims, 9 Drawing Sheets

EVACUATED STRUCTURES FOR REMOVING ACCUMULATED AIR

FIELD OF THE INVENTION

The invention relates to air control in fluidic containers. More specifically it relates to using an evacuated structure to remove air accumulated in a fluid container.

BACKGROUND OF THE INVENTION

After initial filling of a fluid container such as an ink-jet printhead, care is taken to eliminate air bubbles. Later, unwanted air can be introduced into or formed within the fluid container. For instance, with ink-jet cartridges, air bubbles may be introduced when carried in the ink supplied to the pen. Further, air is often diffused with the fluids. Heat, either by ambient temperature or generated by use of the fluid container cause dissolved air within the fluid to form air bubbles within the container. Such air bubbles do not readily re-dissolve back into the fluid when the fluid cools. Air is also drawn into the pen through either orifices used to remove fluid from the containers or slowly through the material that container is made from.

Unwanted air can cause several problems. For instance, in ink-jet printheads, the unwanted air can lead to print quality problems. An air bubble can obstruct ink flow to particular firing chambers from which ink droplets are to be ejected. Air bubbles can cause irregularly shaped ink droplets or cause a printhead to deprime resulting in complete failure of the printhead. Further, the air bubbles can form larger pockets of air that affect the operation of the printhead.

Air present in fluid containers, such as ink containers and printhead cartridges, can interfere with the maintenance of negative pressure often referred to as back-pressure. During environmental changes, such as temperature increases and ambient pressure drops, the air inside a fluid container will expand in proportion to the total amount of air contained within the container. This expansion is in opposition to the internal mechanism (a back-pressure regulator) that maintains the negative pressure. The internal mechanism within the printhead can compensate for these environmental changes only over a limited range of environmental excursions. Outside of this range, the pressure in the fluid container will become positive thereby causing fluid to be expelled from the container. A need exists to prevent unwanted air from affecting the contents of fluid or other containers.

SUMMARY

An evacuated structure removes air accumulated within a container that contains material held at a first pressure. The evacuated structure has a shell that includes a slowly defusing air-permeable material. The air permeable material interfaces to a volume of space evacuated to a second pressure less than the first pressure within the container. Unwanted air that accumulates within the container is drawn into the volume of space of the evacuated structure due to the difference in pressure between the interior of the container and the interior of the shell.

DETAILED DESCRIPTION OF THE PREFERRED AND ALTERNATE EMBODIMENTS

Figure 1:
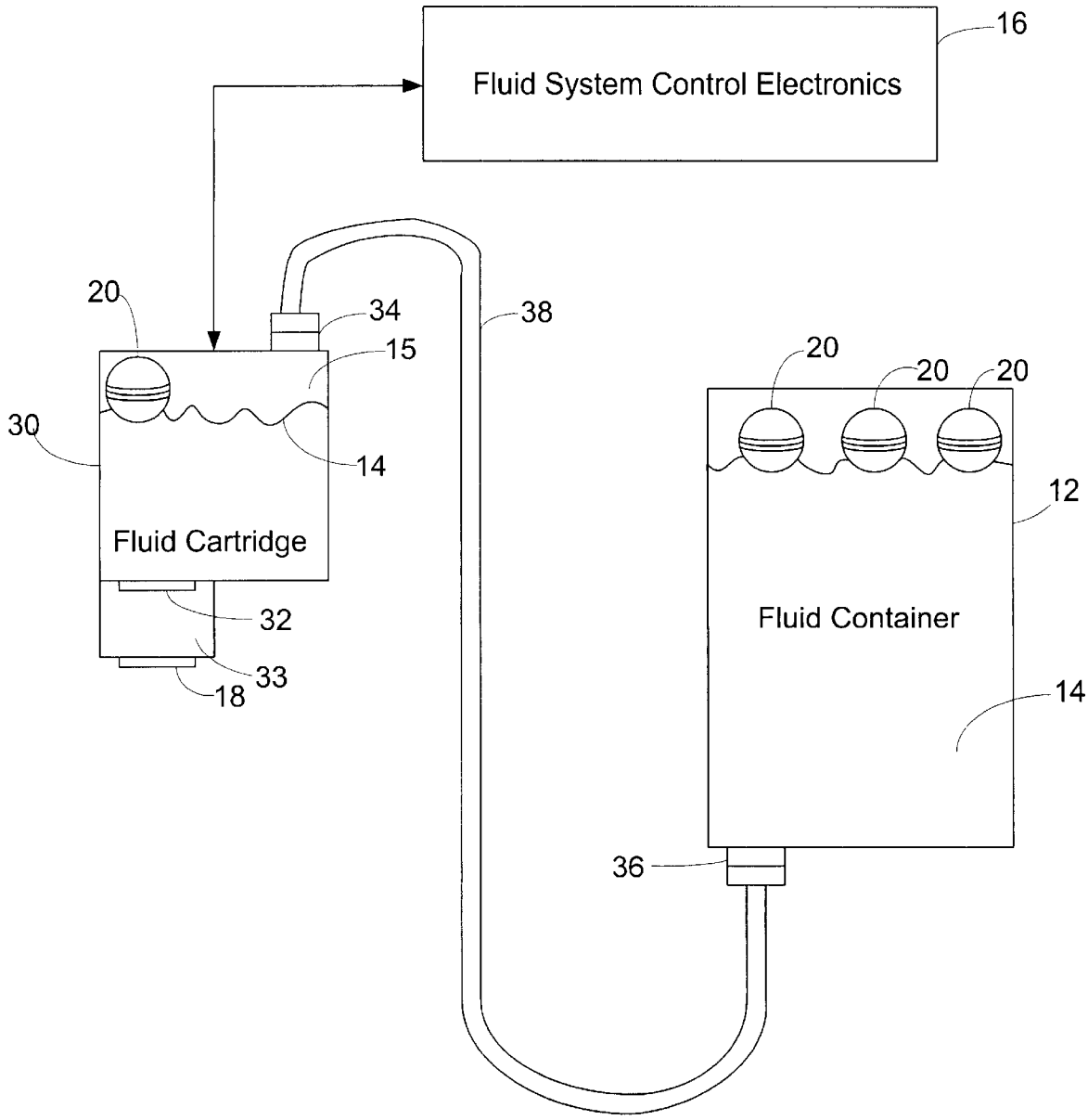
FIG. 1 is an exemplary diagram of a first embodiment of the invention.

The invention utilizes a characteristic of materials that is usually regarded negatively by designers, that is, that air diffuses through many materials, such as plastic containers, thereby introducing unwanted air. The invention utilizes this unwanted property by designers selecting a material specifically for its slowly diffusing air-permeable property and then creating an evacuated structure with it. The evacuated structure is placed within a container (preferably a fluid container) such that it would come in contact with unwanted air that is present or later accumulates within the container. The evacuated structure is manufactured or configured such that its interior is at a lower pressure than that pressure found within the container thereby creating a differential pressure. The differential pressure creates a driving force that moves air from inside the container into the evacuated structure. Therefore, unwanted air that enters the container over time is eventually transferred to the evacuated structure, thereby preventing a detrimental volume of air to accumulate within the container. As air is continually introduced into the evacuated structure, the pressure within the evacuated structure rises until the pressure within the evacuated structure equals the pressure outside the evacuated structure, thereby eliminating the driving force of the pressure differential. The amount of air that can be moved to the evacuated structure depends on the volume of space within the evacuated structure and the initial negative (vacuum) pressure of the evacuated structure and the anticipated pressure within the container. Although some liquid may also be drawn into the evacuated structure, it is usually negligible as the liquid permeability is preferably chosen to be an order of magnitude lower than the air permeability of a given material. A designer can chose an appropriate material such that the amount of liquid absorbed is inconsequential.

One embodiment of the invention includes a small hollow plastic structure or capsule, such as preferably a ⅜ inch diameter sphere or a small cylinder, made of a slowly diffusing air permeable material. Slowly diffusing air permeable materials include Fluorinated Ethylene Propylene (FEP), Perfluoroalkoxy (PFA), Low Density Polyethylene (LDPE), Medium density Polyethylene (MDPE), or High Density Polyethylene (HDPE), to name a few. FEP is a copolymer of polytetrafluoroethene and hexafluoropropylene. It is a soft plastic with relatively low tensile strength, high chemical resistance, a low coefficient of friction, and high dielectric constant that is useful over a wide range of temperatures. PFA is a fully-fluorinated polymer with oxygen cross-links between chains. It is a fairly new polymer with a melt temperature around 580° F. PFA has excellent chemical resistance and is well suited to a variety of modifications. FEP and PFA are available from Modified Polymer Components, Inc. HDPE, MDPE, and LDPE are available from several sources known to those skilled in the art. Other slowly diffusing air-permeable materials exist and are known to those skilled in the art and can be substituted and still remain within the spirit and scope of the invention.

The hollow plastic structure is evacuated to create a low internal pressure. By way of example, this evacuated structure is placed in a fluid container that is otherwise filled with a fluid, such as ink, such that air is not intended to be present. Even when it is intended that air be kept out of a fluid container, many sources allow air (in the form of one or several gases) to collect within the fluid container. The evacuated structure over time accumulates this unwanted air, thereby preventing the unwanted air from interfering with the contents of the fluid container or function of pressure regulators used in the fluid cartridge. Several pressure regulators for controlling back pressure are known to those skilled in the art such as elastic bags, closed-foam material (sponges), and active regulators to name a few.

Preferably, the evacuated structure is allowed to float and/or is placed within the fluid container at a location where the unwanted air accumulates. The unwanted air then contacts with the external shell of the evacuated structure. When an evacuated structure begins its functional life, the interior of the evacuated structure is configured to be at a significantly lower pressure than the pressure of the unwanted air within the fluid container. This pressure differential creates a force that drives the unwanted air through the exterior shell of the evacuated structure and into its interior. As the evacuated structure performs this intended function, the evacuated structure interior increases its internal pressure resulting in a lowering of the pressure differential until no more air passes through the external shell. What unwanted air that was consumed by the evacuated structure, however, remains benign to the fluid container operation or its contents.

For example, the ability to absorb air into an evacuated structure is particularly useful in ink-jet printing technology to prevent ink drooling from a printhead or preventing bubbles from forming an air block wherein the printheads are no longer functional. However, the evacuated structure of the invention has uses in other applications such as the fields of liquid food products (such as wine), medical liquids, and blood products, to name a few. The evacuated structure is also useful in specialized solid food products that are stored under a vacuum seal. The evacuated structure can be put in any package for the purpose of absorbing any air or gas that finds its way into that package. The evacuated structure provides a benefit whenever air or gas that could contact a liquid/solid would diminish the usefulness of the liquid/solid. Capturing and storing the unwanted air or gas within the evacuated structure preserve the usefulness of the liquid/solid. Therefore any liquid/solid that is stored in "air tight" containers in order to keep air or gas from being in contact with the liquid/solid can benefit from using the evacuated structure.

The invention provides several advantages over conventional methods of evacuating air. It is easy to include the evacuated structure into the fluid container during manufacturing of the fluid-containing device. Further, the material used for the air-permeable material can be chosen from a variety of slowly diffusing air-permeable materials to be compatible with the actual fluid used, such as ink. The invention requires no actuation mechanism but optionally one can be incorporated such as a spring or other urging force. Nor does it require a signal or power source to operate. It provides for continuous operation until the pressure differential is eliminated. It is a simple, elegant, and inexpensive solution compared to conventional approaches.

Several different exemplary embodiments of the invention are now shown and described to illustrate various attributes, objects and uses of the invention. Although particular embodiments are shown, these embodiments are only examples of the invention and several modifications can be made by those skilled in the art and still meet the scope and spirit of the invention. The purpose of describing these embodiments is to further demonstrate and illustrate the methods and means of making and carrying out the invention.

FIG. 1 is a exemplary drawing of a first embodiment of the invention. A fluid container 12 for holding fluid 14 has a fluid outlet 36, which includes at least one orifice. Within the fluid container 12 are one or more evacuated structures 20. The evacuated structures are evacuated to a first pressure less than the atmospheric pressure outside of fluid container 12. The purpose of the evacuated structures 20 are to absorb gases which are released from fluid 14 or inadvertently admitted through interconnections, housing shells, fluid interconnect tubing, etc. The evacuated structures 20 are made of a semi-permeable material, such as FEP, PFA, LDPE, MDPE, or HDPE, which allows for a very slow diffusion of air through the material when there is a pressure differential across the material. Any air that is released from the fluid is drawn into the evacuated structure and captured.

The fluid outlet 36 is shown connected to a fluid inlet 34 of a fluid cartridge 30, another type of fluid container, using a fluid tube 38 or other conduit.

The fluid cartridge 30 includes a fluid-jet output device, preferably a thermal ejection device but alternatively a piezoelectric, electro-strictive, or other energy dissipating structure.

The fluid-jet 18 has one or more orifices (nozzles) for ejecting fluid from the fluid cartridge 30. The fluid-jet 18 is controlled by fluid system control electronics 16. The fluid 14 within the fluid cartridge 30 is filtered with screen 32 when the fluid leaves first fluid chamber 15 before entering the second fluid chamber 33. It should be noted that fluid cartridge 30 often includes a backpressure regulator (not shown) contained within first fluid chamber 15. The backpressure regulators commonly used are spring bags and electronic sensor/valve control, to name a couple.

Figure 2:
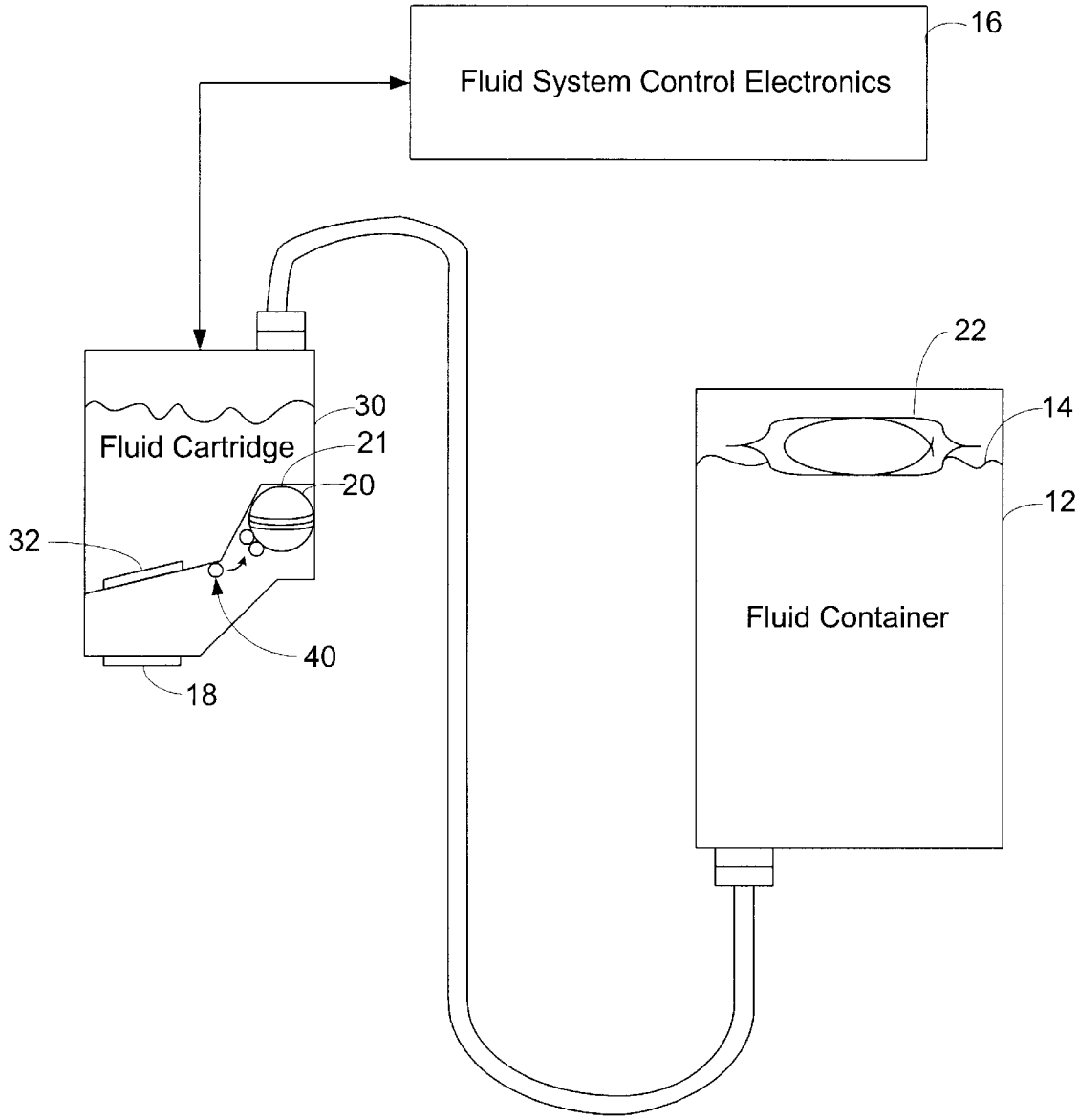
FIG. 2 is an exemplary diagram of a second embodiment of the invention.

FIG. 2 is an exemplary illustration of a second embodiment of the invention. The fluid container 12 holding ink 14 has an alternative embodiment of an evacuated structure 22 that includes an urging force member. Evacuated structure 22 is able to maintain a negative pressure within it lower than the fluid container internal pressure by using an urging force member, such as a spring to continually apply pressure against a semi-permeable material. Also, in an alternative fluid cartridge 30, the evacuated structure 20 is disposed within a second chamber beneath the shelf 21. The screen 32 and shelf 21 of the second chamber are preferably inclined to allow air bubbles 40 that are outgased from the fluid to rise towards the evacuated structure 20. The pressure differential between the inside of the evacuated structure 20 and the fluid within the fluid cartridge 30 causes the air bubbles to diffuse through the semi-permeable material into the evacuated structure 20.

Figure 3:
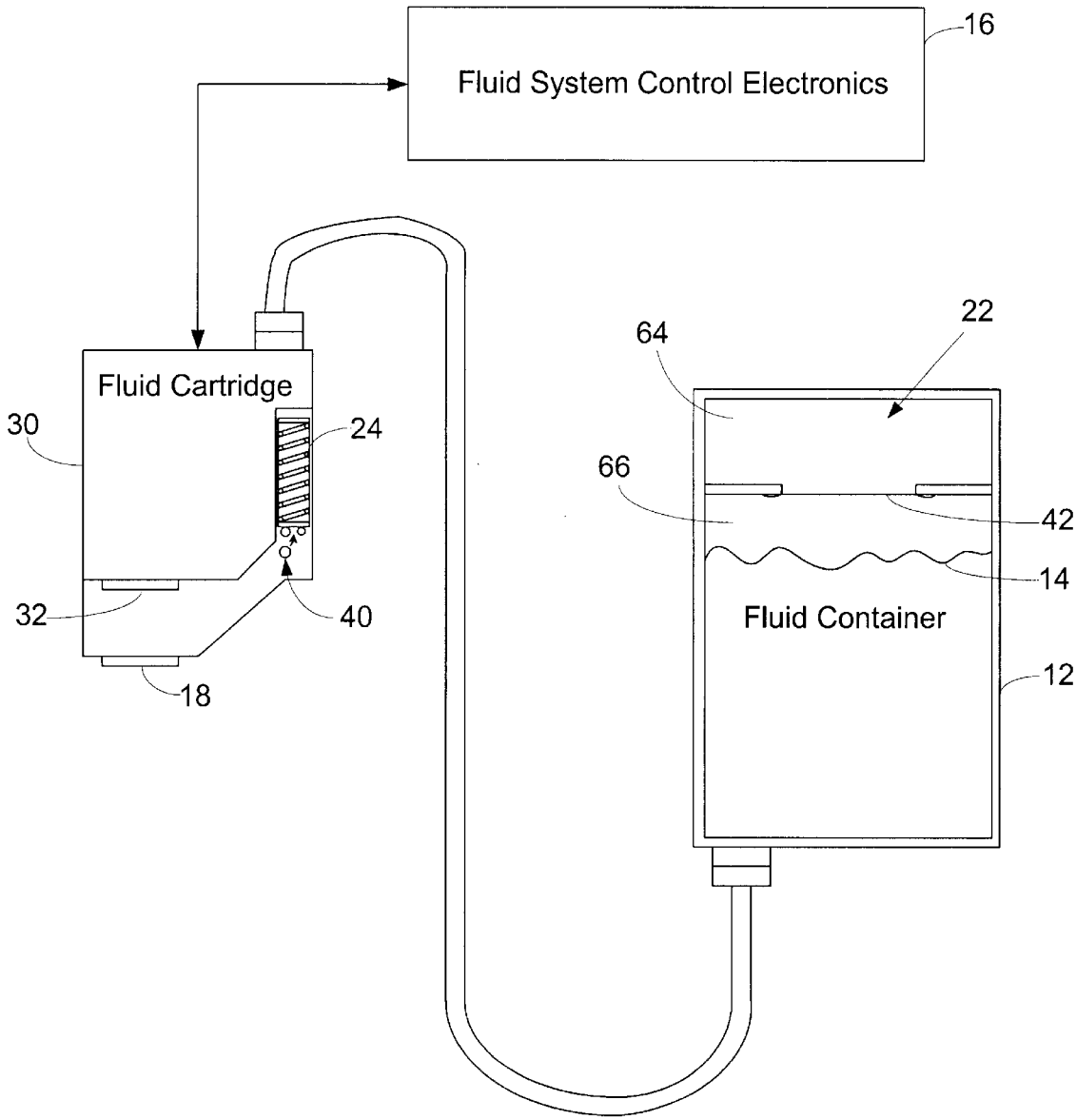
FIG. 3 is an exemplary diagram of a third embodiment of the invention.

FIG. 3 is an exemplary illustration of a third embodiment of the invention. In this embodiment, fluid container 12 includes a separate chamber 64 creating the evacuated structure 22, which is integral to the fluid container 12. A semi-permeable membrane 42 separates the fluid-containing chamber 66 from the evacuated structure chamber 64. The semi-permeable membrane 42 is chosen preferably to be air permeable but not very liquid permeable. When fluid container 12 is fabricated, or preferably after fluid or other air sensitive material is placed in the container, the separate chamber 64 is evacuated to create an integral evacuated chamber.

Also shown in FIG. 3, an alternative fluid cartridge 30 illustrates an alternative evacuated structure 24 having a coiled spring urging member. Air bubbles 40 are directed in an air conduit to a semi-permeable shell surrounding the coiled spring. The pressure within the evacuated structure 24 is configured to be lower than the pressure within the fluid cartridge thereby causing the air bubbles 40 to enter the evacuated structure 24 and be captured, thus preventing an air lock condition in fluid-jet 18 from occurring.

Optionally, the air conduit extends from the lower fluid chamber interfacing to the fluid-jet output device 18 to the main fluid chamber for routing air accumulated in the lower fluid chamber to the main fluid chamber. In this option, the evacuated structure 24 is disposed within the main fluid chamber (not as shown).

Figure 4:
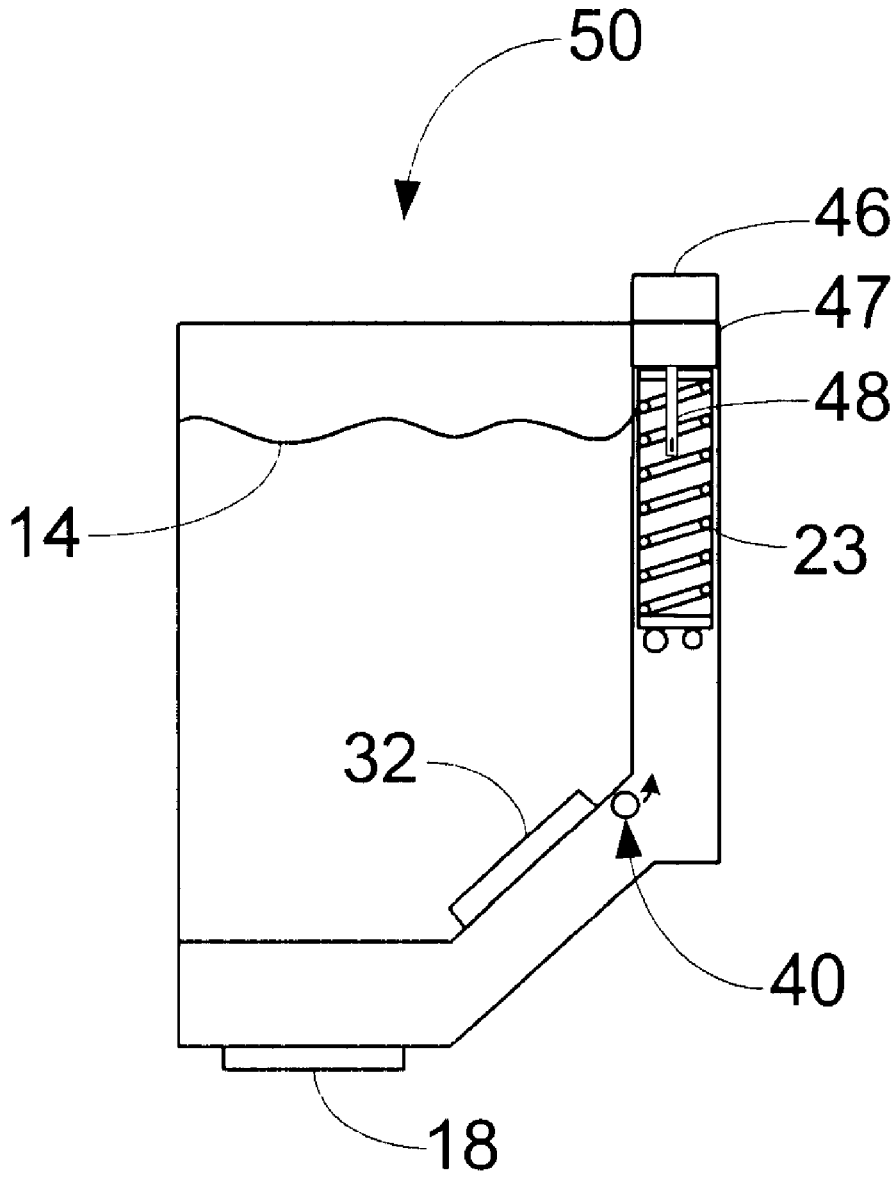
FIG. 4 is an exemplary diagram of a fourth embodiment of the invention.

FIG. 4 is an alternative embodiment of another fluid container, a stand-alone fluid cartridge 50. In this embodiment, air bubbles 40 are directed to evacuated structure 23 since screen 32 is set at an inclined angle. Optionally, evacuated structure 23 includes a septum 47 that is preferably interfaced with a hollow needle 48 that is further coupled to a re-evac port 46. When air is released from the fluid 14 or enters the chamber interfacing with the fluid-jet, the air bubbles 40 flow to and enter evacuated structure 23. The urging force within evacuated structure 23 helps to maintain a lower pressure within evacuated structure 23. By coupling a vacuum source (not shown) to re-evac port 46 (such as when the fluid container is stored), the gas recovered within evacuated structure 23 is removed and the cartridge allowed to continue operating with evacuated structure 23 continuing to remove unwanted air that later accumulates.

Figure 5:
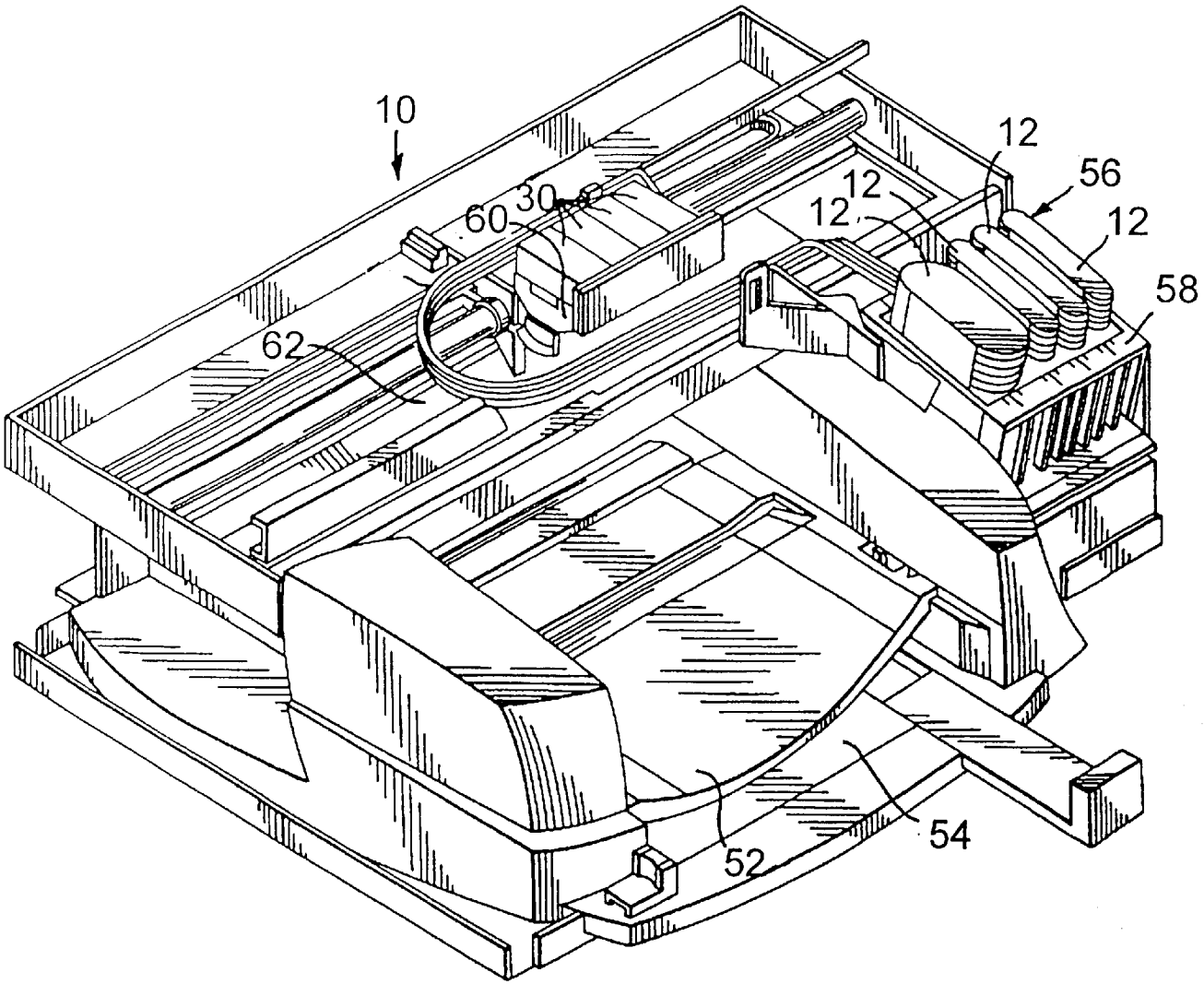
FIG. 5 is an exemplary illustration of a recording device incorporating the invention.

FIG. 5 is an exemplary illustration of a recording device 10, a printer, which incorporates the invention. In the recording device 10, a media is place on a media input tray 54 and transported pass one or more fluid cartridges 30 using media transport mechanism 62. The fluid cartridges 30 are transported in preferably an orthogonal direction to the media movement using cartridge transport 60. The recording device 10 has a housing 58 that stores one or more fluid containers 12 in a user accessible port 56 that are coupled to the fluid cartridges 30 on the cartridge transport 60. Through the use of fluid system control electronics 16 (see FIG. 1), images, data, patterns, or other arrays of fluid are deposited on the media. The media after recording is deposited on the media output tray 52.

Figure 6A:
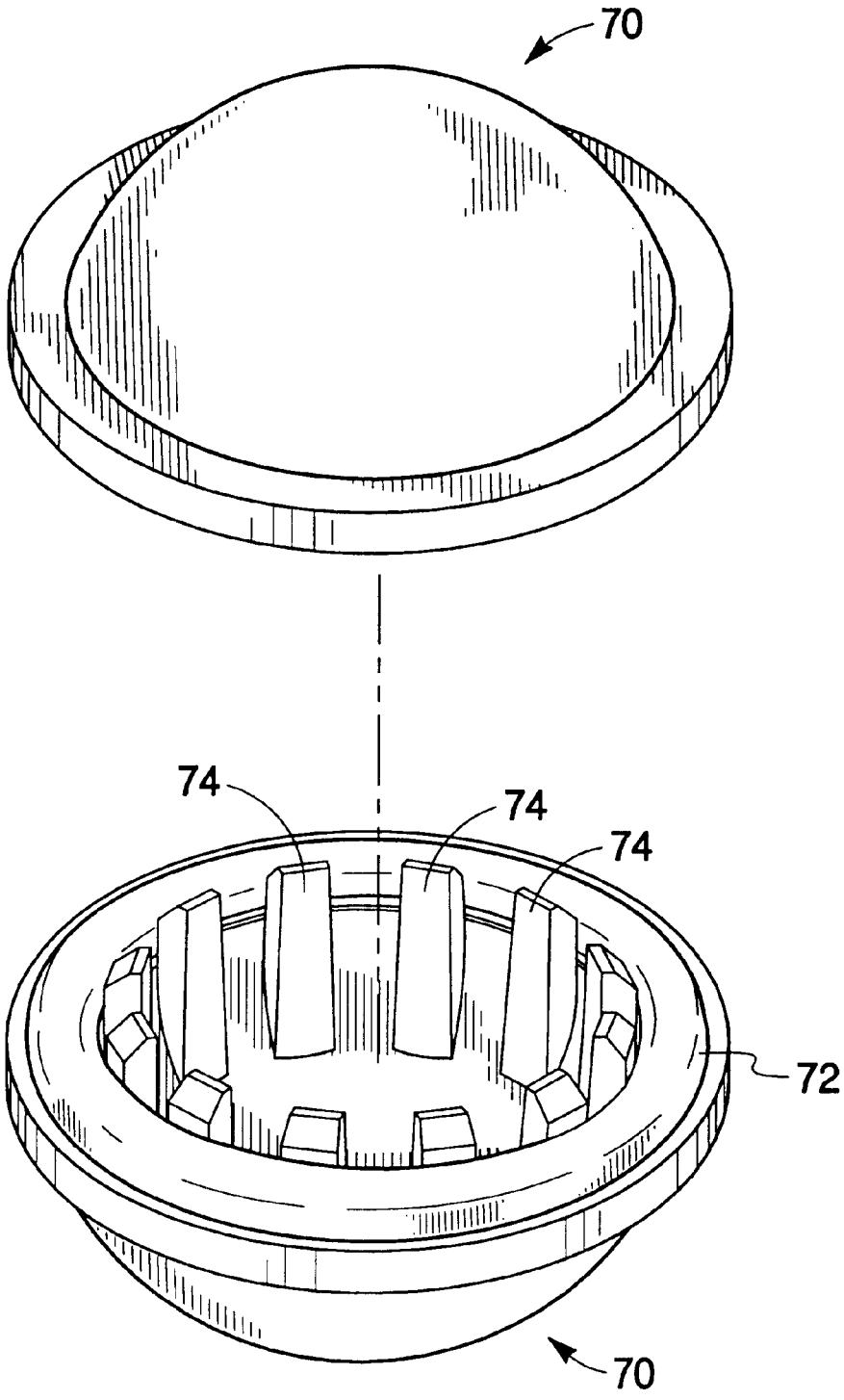
FIGS. 6A–6C are exemplary illustrations of a first embodiment of an evacuated structure having a self-supporting shell.
Figure 6B:
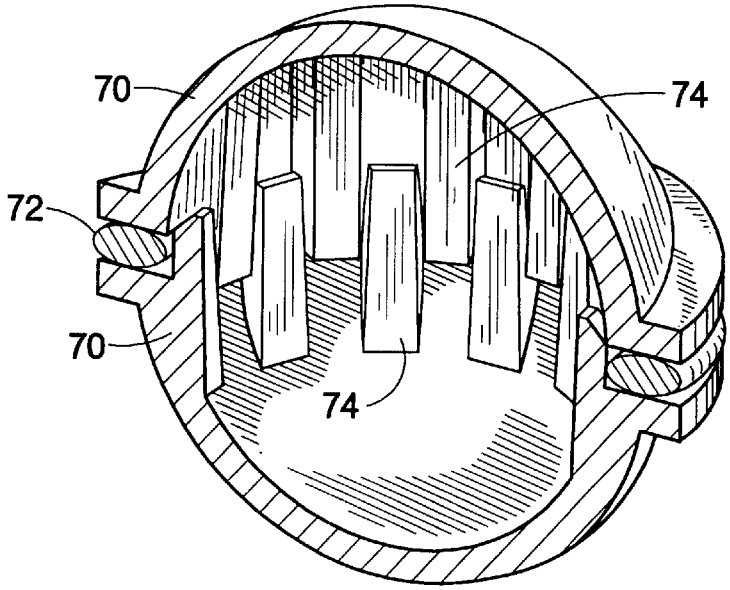
Figure 6C:
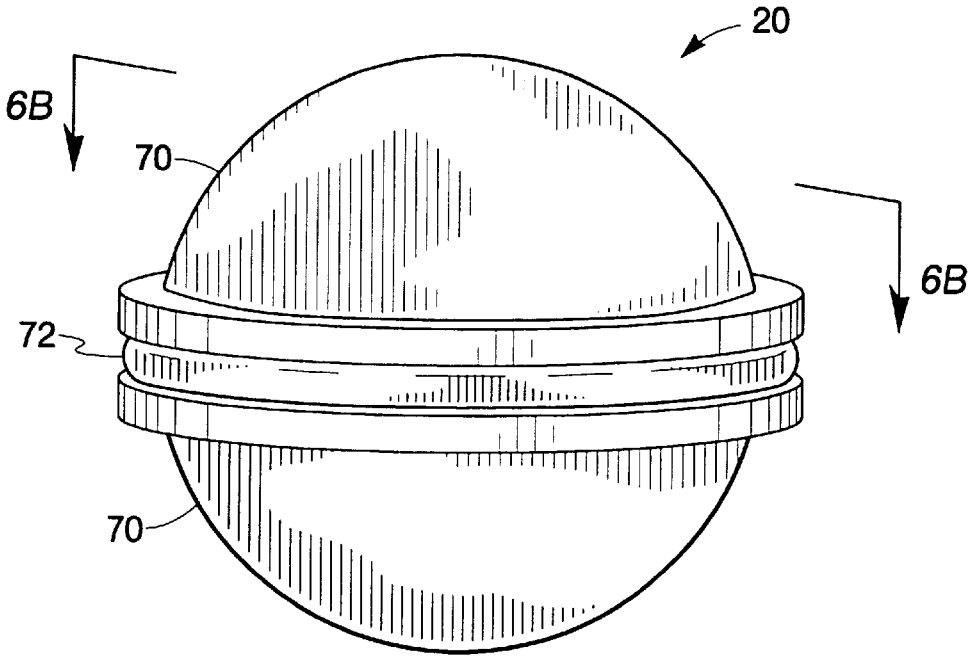

FIGS. 6A–6C illustrate an exemplary evacuated structure. In FIG. 6A, a portion of the evacuated structure is formed of an external shell 70 formed preferably as a semi-sphere although other shapes such as cylindrical or capsule, to name a couple, are possible and still meet the scope and spirit of the invention. The external shell 70 has a small lip encompassing the opening of the semi-sphere upon which is disposed a gasket 72, preferably wetted with a sealing lubrication compound. Within the internal structure of the semi-sphere are interlocking mechanisms 74, exemplarily shown here as interspersed molded fingers.

FIG. 6B is a cut-away view of the assembled evacuated structure illustrating its assembly. Two external shells 70 have their opening facing each other and are separated by gasket 72 that prevents gas or liquid from entering through the mating of the two semi-sphere external shells 70. The interlocking mechanisms 74 are press fitted between each other in contact with the opposite semi-sphere. The friction between the interlocking mechanism 74 and the opposite external shell 70 provide a holding mechanism along with the difference in pressure between the internal evacuated space and the eternal pressure to keep the gasket 72 compressed as a seal. The external shells 70 are made of preferably a gas only permeable material, although a material that allows some liquid permeation can be used and still meet the scope and spirit of the invention.

FIG. 6C is a perspective view of the assembled evacuated structure 20 showing the two external shells 70 and the mesially interposed gasket 72 used as a seal. Other possible seals are known to those skilled in the art and can be substituted for the gasket seal and still meet the spirit and scope of the invention. The alternative seals include ultrasonic welding, adhesives, spin welds, and solvent bonding to name a few. Preferably, the assembled evacuated structure 20 is ⅜ inch or less in diameter for a typical ink-jet cartridge, however, the actual size required would be dependent on the application in which it is used.

Other methods of constructing an evacuated structure are possible and several alternative embodiments are now shown and described.

Figure 7:
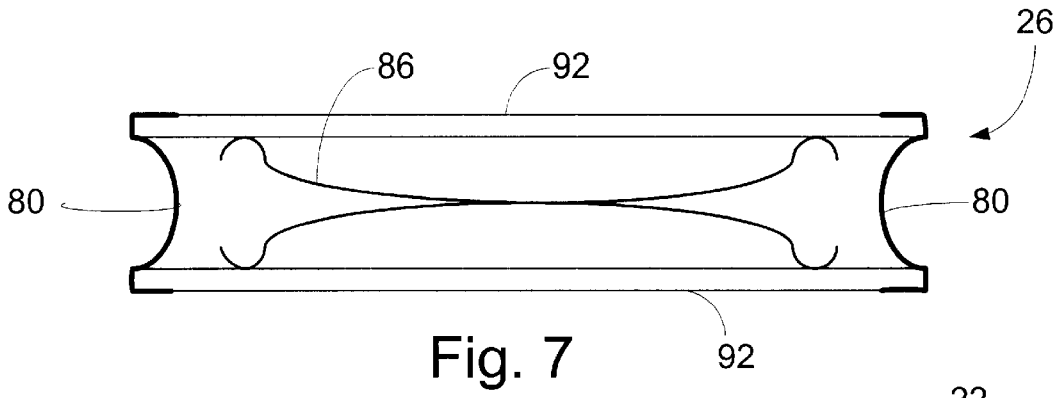
FIG. 7 is an exemplary illustration of a second embodiment of an evacuated structure having an urging force.

FIG. 7 is an alternative embodiment of an evacuated structure. This first alternative evacuated structure 26 has two rigid plates 92 separated using a first urging force 86, such as at least one leaf spring. The two rigid plates 92 are pressed together to compress the urging force and sealed and enclosed using an air-permeable membrane 80, preferably in an evacuated environment. As the two rigid plates 92 are urged apart, the volume of space enclosed within the first alternative evacuated structure 26 grows larger and the air pressure within becomes smaller. This action creates a continuing pressure differential between the pressure within the evacuated structure 26 and the pressure outside of evacuated structure 26.

Figure 8:
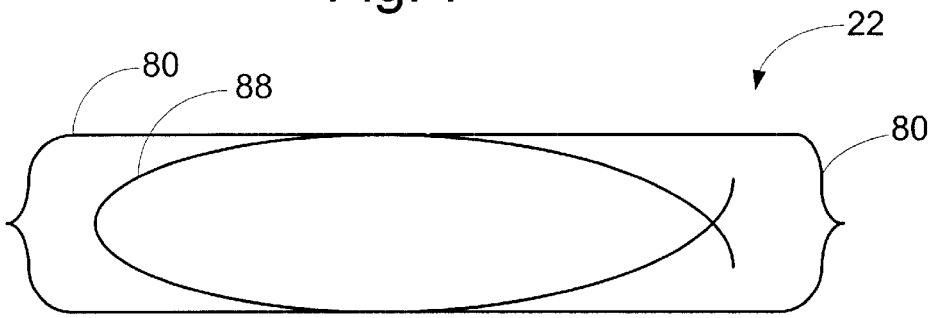
FIG. 8 is an exemplary illustration of a third embodiment of an evacuated structure having an urging force.

FIG. 8 is another alternative embodiment of an evacuated structure. This second alternative evacuated structure 22 includes an air-permeable membrane 80 in the form of a sealed tube bag that has a second urging force 88 shown as a spring that applies a force within the bag to expand its volume. When manufactured, the tube bag is evacuated and the spring compressed. The spring provides a continuing force on the bag such that as air from outside the bag is drawn within due to the pressure differential, the bag expands to increase the volume thus maintaining a pressure differential.

Figure 9A:
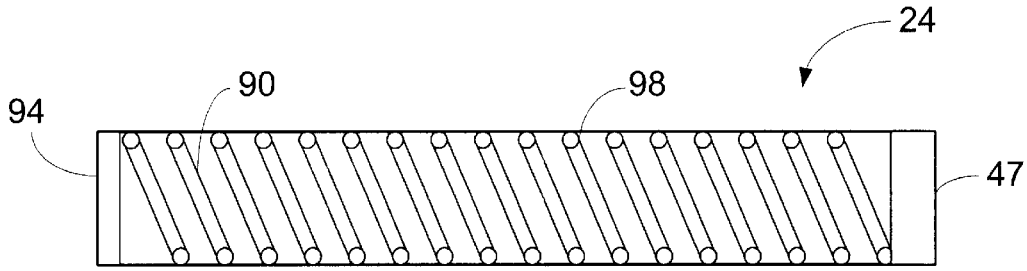
FIG. 9A is an exemplary illustration of a fourth embodiment of an evacuated structure having an urging force in a first state.
Figure 9B:
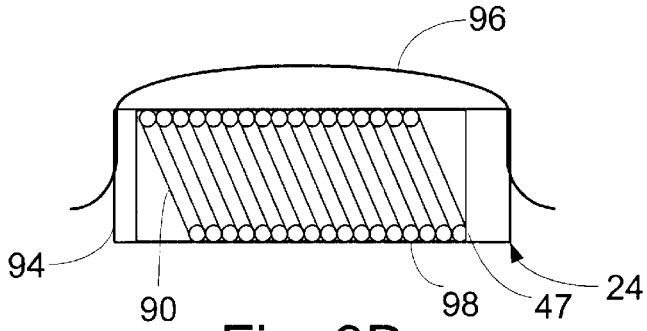
FIG. 9B is an exemplary illustration of the fourth embodiment of FIG. 9A in a second state held by a clip.

FIGS. 9A and 9B are exemplary illustrations of a third alternative embodiment of the evacuated structure. This third evacuated structure 24 includes a third urging force 90, a coiled spring, that provides a force to separate an end plate 94 and a septum 47 (or optionally another end plate 94). The end plate 94 and the septum 47 are enclosed and sealed using a flexible air permeable membrane 98, such as an elastic balloon material. This embodiment allows the septum 47 to provide an interface to an external vacuum source that is used to evacuate or re-evacuate the air that is captured within the third evacuated structure 24. FIG. 9B shows the third evacuated structure 24 in a compressed state that is held in place with a clip 96 to prevent the urging force from applying a separating force between the end plate 94 and the septum 47. This clip 96 allows for shipment of the third evacuated structure 24 before it is assembled in a container to preserve its useful life. An appropriately designed clip 96 can be used for any of the embodiments having an urging force within.

It should be noted that when using an evacuated structure having an urging force within, the volume of the evacuated structure would increase as air/gas is absorbed. This increase of volume may affect the operation of a backpressure regulator if used in a liquid container. However, if possible, the backpressure regulator can be adjusted to compensate for this increase of volume or preferably, a rigid evacuated structure is used in applications employing backpressure regulators. In applications in which the container does not contain a pressure regulator, an evacuated structure having an urging force within allows for a larger volume of air/gas to be absorbed. Even if the slowly diffusing air-permeable material does not have rigid properties, an evacuated structure can be fabricated using it to take advantage of its slowly diffusing air-permeable properties.

Figure 10:
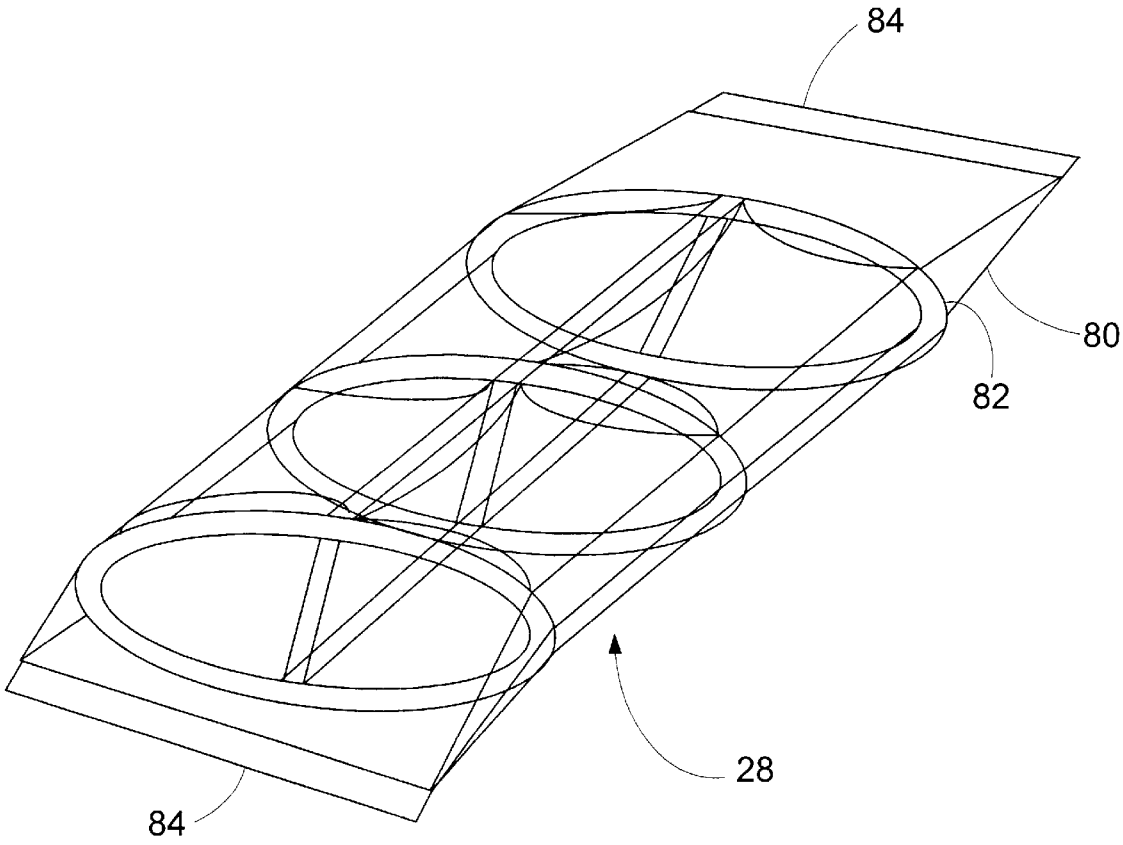
FIG. 10 is an exemplary illustration of a fifth embodiment of an evacuated structure having an internal rigid frame.

For example, FIG. 10 is an exemplary illustration of a fourth alternative embodiment of the evacuated structure. This fourth evacuated structure 28 includes a structure frame 82 within an air-permeable membrane 80 that is formed into a tube bag. The tube bag has two ends 84 that are heat-sealed after the structure frame 82 is inserted within the air permeable membrane 80 and the air evacuated from within. For instance, the structure frame 82 is created and inserted into a tube of the air-permeable material, then each of the ends of the tube are sealed. Either the assembly is done in an evacuated environment or optionally, after one end of the tube is sealed, the tube bag is evacuated and the second end of the tube is sealed. Optionally, an urging mechanism can be substituted for the structure frame 82.

While preferred embodiments of the invention have been shown and described in detail, it will be apparent to those skilled in the art that the disclosed embodiments may be modified. Therefore the foregoing description is to be considered exemplary rather than limiting, and the true scope of the invention is that defined in the following claims.

What is claimed is:

1. A hollow evacuated structure for removing accumulated air within a container containing material held at a first pressure, comprising:

a hollow shell including a slowly defusing air-permeable material surrounding a volume of space evacuated to a second pressure less than the firs pressure wherein air accumulated within the container is drawn into the volume c space due to the difference in pressure between the container and the hollow shell wherein the hollow shell is not interfaced to an external vacuum source.

2. The hollow evacuated structure of claim 1, wherein the hollow shell is a self-supporting structure.

3. The hollow evacuated structure of claim 1 further comprising a frame structure for supporting the hollow shell.

4. The hollow evacuated structure of claim 1 wherein the slowly defusing air-permeable material is chosen from the group consisting of fluorinated ethylene propylene, perfluoroalkoxy, low density polyethylene, medium density polyethylene, or high density polyethylene.

5. The hollow evacuated structure of claim 1 wherein the hollow evacuated structure is integral to the container.

6. The hollow evacuated structure of claim 1 wherein the shape of the hollow shell is spherical.

7. The hollow evacuated structure of claim 1 wherein the shape of the hollow shell is cylindrical.

8. The hollow evacuated structure of claim 1 wherein the shape of the hollow shell is pillow shaped.

9. The hollow evacuated structure of claim 1 further comprising an urging mechanism within and adapted to contact the hollow shell for creating a force within the hollow shell.

10. A fluid container, comprising:

at least one hollow evacuated structure of claim 1 having the second pressure less than atmospheric pressure; and a fluid reservoir containing a fluid and the at least one evacuated structure the fluid reservoir maintained at the first pressure greater than the second pressure but less than the atmospheric pressure.

11. The fluid container of claim 10 further comprising a shelf attached to the fluid container and adapted to prevent the at least one hollow evacuated structure from floating to the surface of the fluid within the fluid container.

12. The fluid container of claim 10 further comprising a filter screen separating a first fluid chamber from a second fluid chamber, the second fluid chamber having at least one orifice for allowing fluid to be removed from the fluid container.

13. The fluid container of claim 12 wherein the at least hollow evacuated structure is disposed between the filter screen and the at least one orifice.

14. The fluid container of claim 12 further comprising an air conduit extending from the second fluid chamber to the first fluid chamber for routing air accumulated in the second fluid chamber to the first fluid chamber.

15. The fluid container of claim 14 wherein the at least one hollow evacuated structure is disposed within the air conduit.

16. The fluid container of claim 10, further comprising a printhead for ejecting fluid from the fluid container.

17. A printer comprising at least one fluid container of claim 10.

18. A hollow evacuated structure for removing accumulated air within a container containing material held at a first pressure, comprising:

a hollow shell including a slowly defusing air-permeable material surrounding a volume of space evacuated to a second pressure less than the first pressure wherein air accumulated within the container is drawn into the volume of space due to the difference in pressure between the container and the shell, wherein the hollow shell comprises:

a first enclosure having an interlocking mechanism;

a second enclosure, identical to the first enclosure; and a gasket disposed between the first and second enclosure;

wherein the interlocking mechanisms on the first and second enclosure are engaged with the opposite positioned enclosure.

19. A method of evacuating air from a fluid container, comprising the steps of:

inserting a hollow evacuated structure not interfaced to an external vacuum source, the hollow evacuated structure having an internal first pressure within the fluid container; and setting the pressure within the fluid container to a second pressure greater than the first pressure.

20. The method of claim 19 further comprising the steps of trapping the hollow evacuated structure beneath a shelf within the fluid container wherein the shelf is designed to direct air bubbles to the hollow evacuated structure.

21. The method of claim 19 wherein the fluid container has a first fluid chamber and a second fluid chamber separated by a filter screen, the method further comprising the steps of trapping the hollow evacuated structure within the second fluid chamber.

22. The method of claim 19 wherein the fluid container has a first fluid chamber and a second fluid chamber separated by a filter screen, the method further comprising the step of routing air from the second fluid chamber to the first fluid chamber.

23. A method of creating a sealed hollow evacuated structure, comprising the steps of:

molding two semispherical shells of an air-permeable material;

assembling the two semispherical shells in a vacuum environment; and sealing the two semispherical shells thereby creating the sealed hollow evacuated structure.

24. The method of claim 23, wherein the step of assembling the two semispherical shells includes the step of applying a seal between the two semispherical shells.

25. A method of creating a sealed hollow evacuated structure, comprising the steps of:

creating a frame support structure;

inserting the frame support structure within a tube of air-permeable material;

evacuating the tube of air-permeable material; and sealing the ends of the tube of air-permeable material in a vacuum environment thereby creating the sealed hollow evacuated structure.

26. The method of claim 25 wherein the step of sealing the ends of the tube of air-permeable material further comprises the steps of:

sealing a first end of the tube of air-permeable material;

evacuating the air from the tube of air-permeable material; and sealing a second end of the tube of air-permeable material.

27. A method of creating an evacuated structure, comprising the steps of:

creating a urging force mechanism;

inserting the urging force mechanism within a structure of air-permeable material; and evacuating the structure of air-permeable material of air.

28. An evacuated structure for removing accumulated air within a container containing material held at a first pressure, comprising:

a shell including a slowly defusing air-permeable material surrounding a volume of space evacuated to a second pressure less than the first pressure wherein air accumulated within the container is drawn into the volume of space due to the difference in pressure between the container and the shell; and wherein the shell comprises:

a first enclosure having an interlocking mechanism;

a second enclosure, identical to the first enclosure; and a gasket disposed between the first and second enclosure;

wherein the interlocking mechanisms on the first and second enclosure are engaged with the opposite positioned enclosure.

29. An evacuated structure for removing accumulated air within a container containing material held at a first pressure, comprising:

a shell including a slowly defusing air-permeable material surrounding a volume of space evacuated to a second pressure less than the first pressure wherein air accumulated within the container is drawn into the volume of space due to the difference in pressure between the container and the shell; and an urging mechanism for creating a force within the shell.

30. A fluid container, comprising:

a fluid reservoir containing a fluid having a first pressure less than atmospheric pressure;

at least one evacuated structure, comprising:

a shell including a slowly defusing air-permeable material surrounding a volume of space evacuated to a second pressure that is less than the first pressure of the fluid reservoir wherein air accumulated within the container is drawn into the volume of space due to the difference in pressure between the container and the shell;

a filter screen separating a first fluid chamber from a second fluid chamber, the second fluid chamber having at least one orifice for allowing fluid to be removed from the fluid container and an air conduit extending from the second fluid chamber to the first fluid chamber for routing air accumulated in the second fluid chamber to the first fluid chamber.

31. The fluid container of claim 30 wherein the at least one evacuated structure is disposed within the air conduit.

* * * * *

UNITED STATES PATENT AND TRADEMARK OFFICE

CERTIFICATE OF CORRECTION

PATENT NO. : 6,557,990 B2
DATED : May 6, 2003
INVENTOR(S) : Altendorf

It is certified that error appears in the above-identified patent and that said Letters Patent is hereby corrected as shown below:

Column 7,
Line 55, delete “firs” and insert therefor -- first --.
Line 57, delete “c” and insert therefor -- of --.

Column 8,
Line 19, delete “structure” and insert therefor -- structure, --.
Line 31, after “least”, insert -- one --.

Column 9,
Line 28, delete “shells.” and insert therefor -- shells before the step of sealing. --.
Line 50, after “material;”, delete “and”

Column 10,
Line 1, delete “air.” and insert therefor -- air; and allowing the urging force mechanism to create a pressure differential by increasing the volume of the evacuated structure wherein the evacuated structure is not interfaced to an external vacuum source. --
Lines 22 and 34, before “shell”, insert -- hollow --.
Line 28, delete “shell.” and insert therefor -- shell, wherein the hollow shell is not configured to interface with an external vacuum source. --
Line 40, delete “shell;” and insert therefor -- shell, wherein the hollow shell is not configured to interface with an external vacuum source; --

Signed and Sealed this

Twenty-second Day of June, 2004

JON W. DUDAS
*Acting Director of the United States Patent and Trademark Office*